US005680987A

United States Patent [19]

Taylor

[11] Patent Number: 5,680,987

[45] Date of Patent: Oct. 28, 1997

[54] THERMALLY ACTUATED, AIR-ATOMIZING SPRAY SHOWER APPARATUS

[75] Inventor: Bruce F. Taylor, Worthington, Ohio

[73] Assignee: Qualitek Limited, Columbus, Ohio

[21] Appl. No.: 379,203

[22] Filed: Jan. 27, 1995

[51] Int. Cl.[6] ..... B05B 12/00; B05B 1/24

[52] U.S. Cl. ..... 239/75; 239/135; 162/199; 162/DIG. 6

[58] Field of Search ..... 239/75, 135, 133, 239/132, 128; 134/122 R; 162/275, 199, DIG. 6

[56] References Cited

U.S. PATENT DOCUMENTS

| | | | |
|---|---|---|---|
| 3,856,206 | 12/1974 | Bell et al. | 239/75 |
| 4,209,065 | 6/1980 | Ledent | 239/75 X |
| 4,262,844 | 4/1981 | Sekiya | 239/75 X |
| 4,511,083 | 4/1985 | Muller-Girand | 239/75 X |
| 4,516,928 | 5/1985 | Babington | 239/75 X |
| 5,104,311 | 4/1992 | Maughan et al. | 239/75 X |
| 5,262,955 | 11/1993 | Lewis | 162/DIG. 6 X |

FOREIGN PATENT DOCUMENTS

| | | | |
|---|---|---|---|
| 578069 | 5/1933 | Germany | 239/75 |
| 58-135359 | 8/1983 | Japan | 239/75 |
| 314264 | 7/1956 | Switzerland | 239/75 |
| 185776 | 9/1922 | United Kingdom | 239/75 |

*Primary Examiner*—Lesley D. Morris
*Attorney, Agent, or Firm*—Hale and Dorr LLP

[57] ABSTRACT

The apparatus and method of the present invention generates and controls an air-atomized spray, for application of moisture to a moving sheet, such as paper or converted paper products (e.g. corrugated board). The air-atomized water spray is generated by mixing a metered quantity of water with a constant air volume. In a representative embodiment the water flow is metered by adjusting the axial position of a shut-off needle relative to a circular control orifice. The needle is positioned by pushing and pulling upon it with a thermally-expanded metallic element. The thermally expanded element is heated directly or indirectly, at a controlled rate, to produce the desired needle movement and resultant water flow. A series of such controllable nozzles can be mounted across the width of a sheet to permit localized, metered moisture application to each cross-machine control zone. Accurate, zonal control of the water application rate permits the localized moisture content of the sheet to be increased or decreased to meet quality control objectives.

26 Claims, 11 Drawing Sheets

THERMALLY ACTUATED, AIR-ATOMIZING SPRAY SHOWER APPARATUS

BACKGROUND OF THE INVENTION

1. Field of the Invention

The present invention is directed to an apparatus for generating and controlling an air-atomized water spray.

In the production of sheets of paper or corrugated board it is often desirable to apply controlled amounts of moisture, to localized positions across the width of the sheet. To accomplish this a plurality of separately controlled spray nozzles, arranged in a bank across the sheet's width, is often used to apply water independently to adjacent cross-machine segments of the sheet. When used to control a sheet-fed material's moisture content, the bank of spray nozzles is generally complemented by a downstream scanning moisture measurement which is used to determine the actual moisture content across the width of the sheet. The actual moisture content, represented by an array of position-based moisture values that define the cross-machine moisture profile, is compared to the desired moisture profile (typically a flat target line) by a computer. The computer then calculates the error at each cross-machine position between the actual moisture profile and the desired one, to develop a moisture error profile. Then, by means of suitable interface electronics and nozzle control elements, the computer makes proportional adjustments to individual nozzle flows as needed to drive the error profile to zero.

2. Description of Prior Art

Conventional spray shower devices for controlling moisture on paper or corrugated board sheets during the manufacture of such sheets may be divided into two groups, water-atomized and air-atomized. Water-atomizing shower devices designs use a high water pressure (typically 40 psig or more) upstream of the nozzle orifice to produce an atomized exit spray (droplet sizes are typically 400 to 1500 micron mean volume diameter). By comparison, air-atomized nozzles mix a metered, potentially lower pressure water flow with a high velocity air stream to produce a more finely atomized flow (droplet sizes are typically 50 to 100 micron mean volume diameter).

In both cases the water flow must somehow be metered to provide an adjustable moisture application rate. The conventional water metering technique used by both approaches consists of a series of solenoid-operated orifices to meter the flow in discrete increments. In the most common conventional form, the hardware for each cross-direction control zone includes a manifold block having four (4) different sized orifices internal to it, each of which is sealed by a solenoid-operated plunger. A common upstream water pressure is presented to all four orifices, each of which is sized to pass approximately twice the flow of the previous one. In this manner, energizing the first solenoid permits passage of one unit of flow through the manifold, while energizing only the second solenoid permits passage of two units of flow, etc. The solenoids can also be energized in combinations. For example, energizing the first and second solenoids together allows passage of a total of three units of flow through the manifold, while energizing all four solenoids allows passage of a maximum 15 units of flow. This specific four-solenoid approach therefore permits up to 15 equal flow control steps.

Presumably, conventional water-atomized and air-atomized shower devices use the four (4) different sized orifices because proportional adjustment of a single orifice (e.g. by means of a throttling device such as a needle valve) has previously been too difficult or impractical. For example, throttling of a single orifice with a water-atomized approach is not advisable, because varying the orifice geometry will produce undesirable results, such as variations in spray angle and water droplet size. Conventional air-atomizing showers produce a conical air jet of constant dimension and velocity to eliminate this constraint, but other considerations continue to discourage use of a single water flow control orifice. A unique advantage of air-atomizing showers is the relatively low flow rates they can generate (e.g. a typical flow control range would be 0 to 10 gallons per hour). However, partitioning such small flows into suitable increments, with a single adjustable orifice, requires precise positioning of a throttling element that has proven difficult to achieve in a reliable, cost-effective manner.

With conventional water-atomized spray showers the four spray nozzles associated with each control zone are typically mounted in-line by threading them into a manifold block that is oriented along the same axis as the sheet itself (i.e. the machine-direction). The feed water is presented in parallel to each of the four, solenoid-activated control orifices, each of which controls passage of water to an accompanying spray nozzle orifice of specific size. This arrangement of the spray nozzle has a number of drawbacks, including:

Four solenoids, and four different size spray nozzles, are required for each control zone, adding cost, increasing assembly size, and decreasing reliability.

The smallest orifice must be small enough to produce a reasonable unit flow increment, while being large enough to avoid frequent plugging by contaminants in the water supply. The minimum practical diameter of the smallest orifice (around 0.012 inches) often does not fully satisfy either criteria. In many instances the flow control range is larger than desired, while intermittent plugging persists due to sub-standard water quality.

When an orifice plugs the spray angle and atomization levels may be grossly affected, altering surface coverage and the rate at which moisture is absorbed into the sheet, and sometimes even resulting in a needle-like spray pattern that may noticeably damage the moisturized sheet surface.

Air-atomization overcomes most of the above noted drawbacks. The air stream produces a constant spray angle, atomizing whatever water is introduced into it. This ensures full atomization regardless of the water flow and water orifice condition. The air also provides the energy to atomize the water, so lower water pressures can be used (even as low as 10 psig) than with water-atomized designs. This in turn permits the use of larger water orifice sizes, even for flow rates that are appreciably smaller than those typically provided by water-atomized showers. The air-atomized shower is therefore less prone to plugging, provides smaller water droplets to reduce the risk of marking the moisturized sheet, can accommodate a wider range of flows, and can spray downwards without the risk of dripping when its nozzles are shut-off. Like water-atomized showers, conventional, air-atomized devices also use one manifold block per cross-machine control zone. Each manifold assembly may include three, four or five solenoids (and accompanying flow metering orifices), as required to provide 20, 16 or 32 flow states, respectively. However, with conventional air-atomizing showers the control-zone manifolds are usually located away from the manufacturing equipment. The water flow is thus metered in an off-machine interface enclosure (which houses the individual manifold blocks and their typical compliment of four solenoids each), then conveyed to the appropriate on-machine spray nozzles, for final atomization by the air stream prior to impingement upon the sheet. However, the conventional, air-atomized approach also has its drawbacks, including:

The off-machine enclosure adds cost and requires floor-space.

Four solenoids per control zone are still required, adding cost and reducing inherent reliability.

The tube bundle that connects the off-machine manifold blocks and the on-machine nozzles increases installation cost, and is subject to fouling and physical damage.

The multiple solenoid approach, whether part of a water-atomized or air-atomized apparatus, can only provide a discrete number of control increments (typically 15), and does not allow for direct, manual adjustment (by hand) of the nozzle flow rate (an electronic interface is needed to implement a binary control sequence).

It is therefore a principal object of the present invention to provide an improved method and apparatus for generating and controlling an air-atomized water spray for use during the manufacture of paper or corrugated board sheets.

SUMMARY OF THE INVENTION

The apparatus and method of the invention uses controlled heating and/or cooling of a thermally expandable, metallic element to control the position of a liquid-flow metering element. According to the preferred embodiment of the invention the flow metering element consists of a translating needle which modulates the annular open area that is formed by the insertion of the needle's conical tip into a mating, circular, flow control orifice. In one embodiment of the invention, the needle is attached at its opposite end to a tubular thermal expansion element, which when heated by a contacting heating element, causes the needle to move relative to the flow control orifice. Movement of the needle modulates the amount of water which flows through the variable, annular orifice prior to final mixing with the atomizing air stream. The pressurized, atomized mixture is then ejected as a spray towards the surface to be moisturized.

In another embodiment of the invention the thermal expansion element is a thermostatic, bimetal element made of suitable materials. Use of a thermostatic bimetal element produces greater temperature-induced movement and force for a given element mass and temperature rise, thereby reducing the required heater wattage and resulting response time to improve performance. Various forms of bimetal elements are appropriate for use, such as a disc type, strip type, or double helix type, all of which produce linear motion, or a single helix type which produces rotational motion to retract a threaded needle. In one embodiment of the invention the thermal expansion element is directly heated and cooled by one or more thermo-electric coolers (i.e. Pelltier coolers, or TEC's) which are sandwiched between a surface of the thermal expansion element and the surface of a suitable heat sink.

In one embodiment, the thermal expansion element is indirectly heated and cooled by exposing it to an air stream whose initial temperature is controlled by an upstream heater circuit. Using air to indirectly heat and cool the heating element has numerous potential advantages. Indirect heating and cooling of the bimetal element with forced convection equalizes the response time in heating and cooling. Furthermore, the source temperature of the originally unheated air may be easily controlled to provide a uniform position-datum for the multiple bimetal elements incorporated in a plurality of nozzles. Furthermore, the pressurized air flow, being circulated over the bimetal elements, and through sealed sleeves within which the bimetal elements can be contained, serves to protect the bimetal elements from potentially corrosive components in the surrounding ambient environment that might otherwise come into contact with the bimetal elements.

In another embodiment of the invention, two counteracting bimetal elements are used to compensate for ambient temperature changes. The bimetal elements are arranged adjacent to one another, and perpendicular to the axis of the nozzle and flow control needle, and bow in the same direction when heated by bonded foil-type heaters. To simplify manufacture and mounting of the two bimetal elements, they are rectangular in shape, and to render the two bimetal elements corrosion-resistant, their exterior surfaces are plated with a suitable material such as chrome or tin. Only one bimetal element may be heated to simplify the heater control circuitry. Alternatively, a more complex control circuit may be incorporated which uses a balancing resistor in order to control the heating of both bimetal elements. This approach maximizes the control range for a given heater wattage and maximum allowable bimetal element temperature, and also produces approximately equal rates of needle movement in both directions.

The various potential expansion elements and heating and/or cooling methods may be complemented by a feedback device of various forms, so as to provide more accurate control of the flow control element's position, and so as to provide a diagnostic indication of the devices operating condition.

The present invention will provide several advantages over previous methods and apparatuses, including;

The ability to adjust water flow in a substantially infinite number of steps to improve control precision.

Reduction of hardware (elimination of solenoids, manifold blocks, external cabinetry, and water transport tubes) to improve reliability and reduce space requirements and cost.

Provision of inherent orifice cleaning resulting from intermittent penetration of the orifice by the throttled needle.

These and other objects and features of the present invention will be more completely described in the following detailed description which should be read in light of the accompanying drawings in which corresponding reference numerals represent corresponding parts throughout the several views.

DESCRIPTION OF THE PREFERRED EMBODIMENTS

Figure 1:
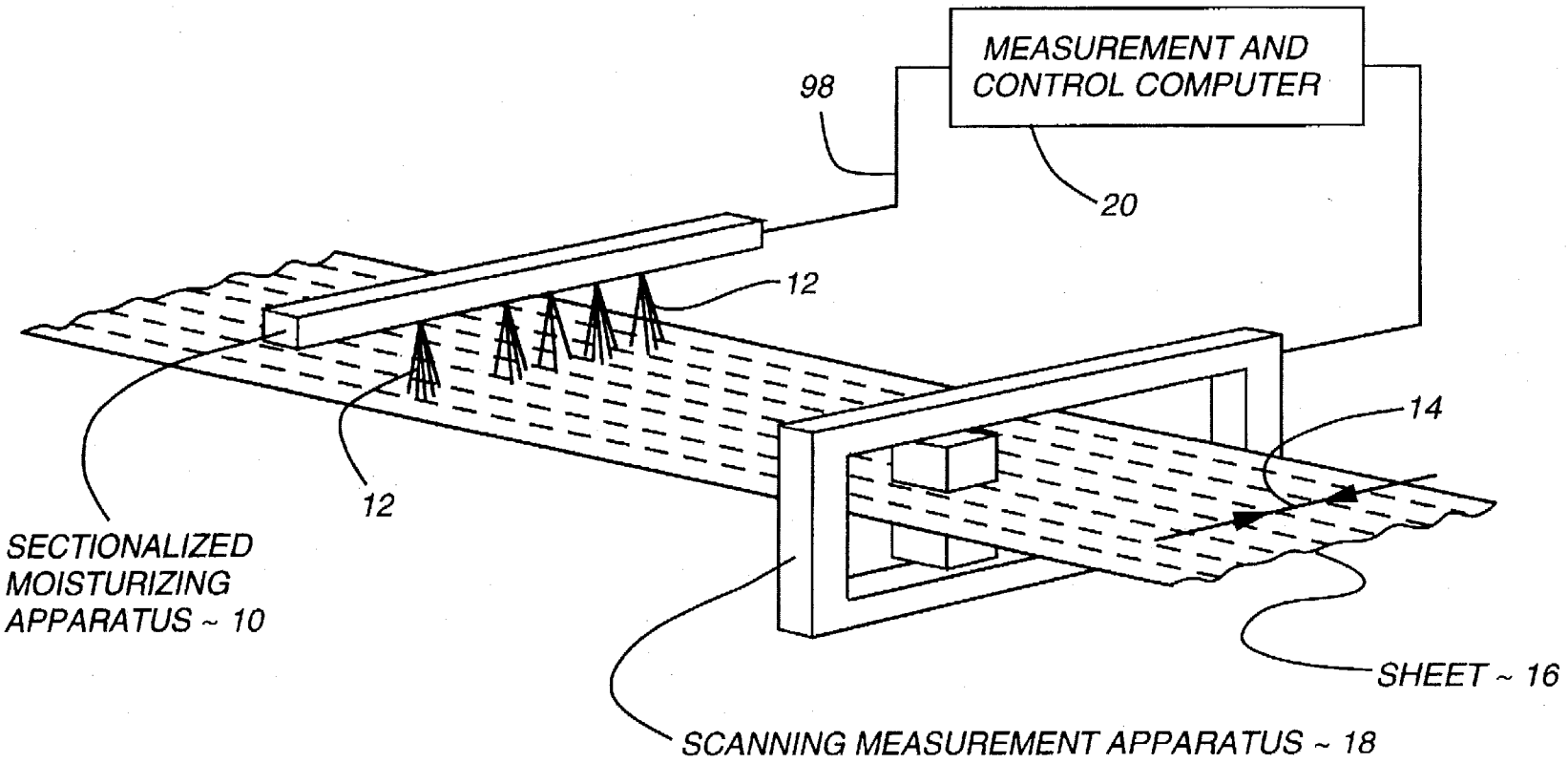
FIG. 1 is a perspective view of a portion of a sheet manufacturing system upon which the spray shower apparatus of the present invention would typically be installed and operated.

Referring to FIG. 1, a moisturizing apparatus 10 is illustrated which produces independently controlled, air-atomized, water spray jets 12 for application of moisture to appropriate cross-machine control segments 14 of a sheet 16 which is traveling adjacent to it. In practice the sectionalized moisturizing apparatus 10 is located above or below the sheet 16, and when used to automatically adjust the moisture content of the sheet 16, is also located upstream of a scanning measurement apparatus 18. The scanning measurement apparatus 18 measures the actual moisture content of the sheet 16 within each cross-machine control segment 14. The actual moisture profile, represented by an array of position-specific moisture values (one or more for each cross-machine segment 14), may then be compared to the desired moisture profile (typically a flat target line) by a measurement and control computer 20. The measurement and control computer 20 may then be used to calculate the error between the actual moisture profile and the desired one, to develop a moisture error profile. Then, by means of suitable control software, interface electronics, and spray element control elements, the measurement and control computer 20 adjusts the water flow rate provided by each individual spray jet 12, as needed to drive the error profile to zero.

Figure 2:
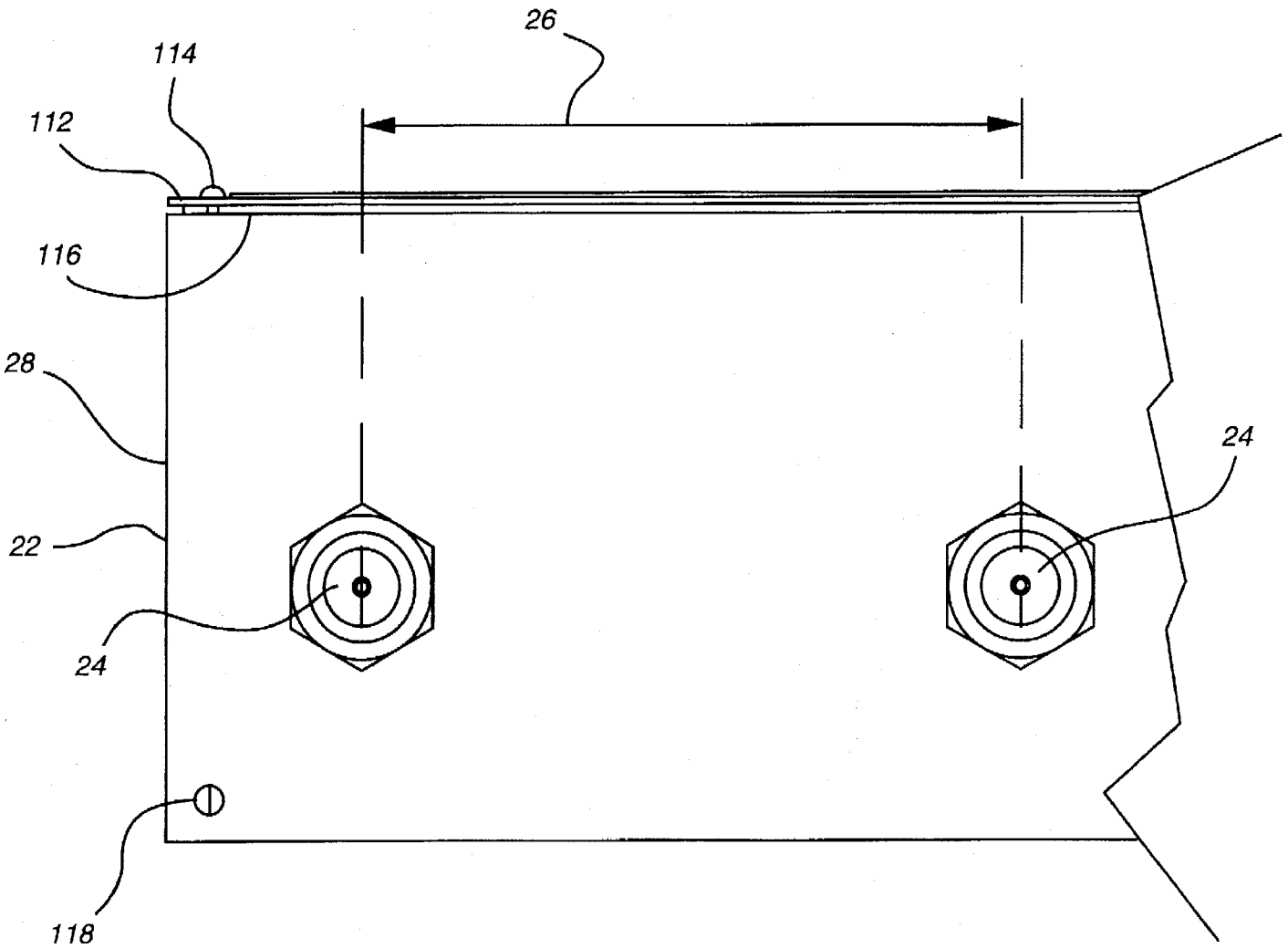
FIG. 2 is a side elevational view of a representative external enclosure for the spray shower apparatus of the system of the present invention, within which are mounted a plurality of thermally-actuated, air-atomizing, water spray nozzles.

Referring now to FIG. 2, the apparatus 22 of the present invention includes a plurality of controllable, air-atomizing, water spray nozzles 24, having a distance 26 between each equal to a cross-machine control segment 14, and each of which are typically centered within a cross-machine control segment 14. The water spray nozzles 24 are typically contained within a sheet-metal enclosure 28, so as to render the assembled sectionalized moisturizing apparatus 1 suitable for use in an industrial environment.

Figure 3:
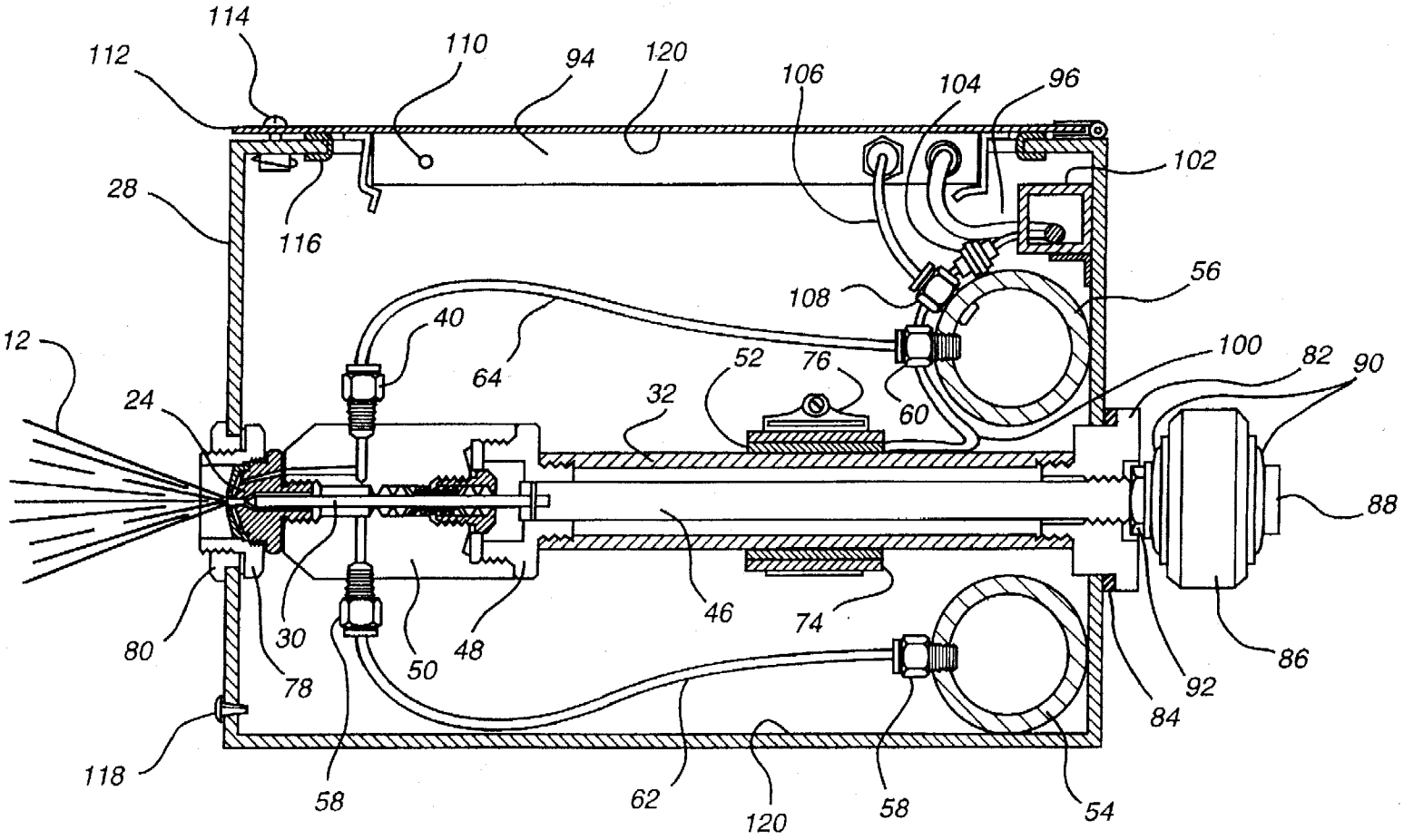
FIG. 3 is a cross-sectional view of one embodiment of the thermal expansion element of the present invention, which is in the form of a metal tube, that moves a water flow control needle when it is heated by a contacting heating element.
Figure 3A:
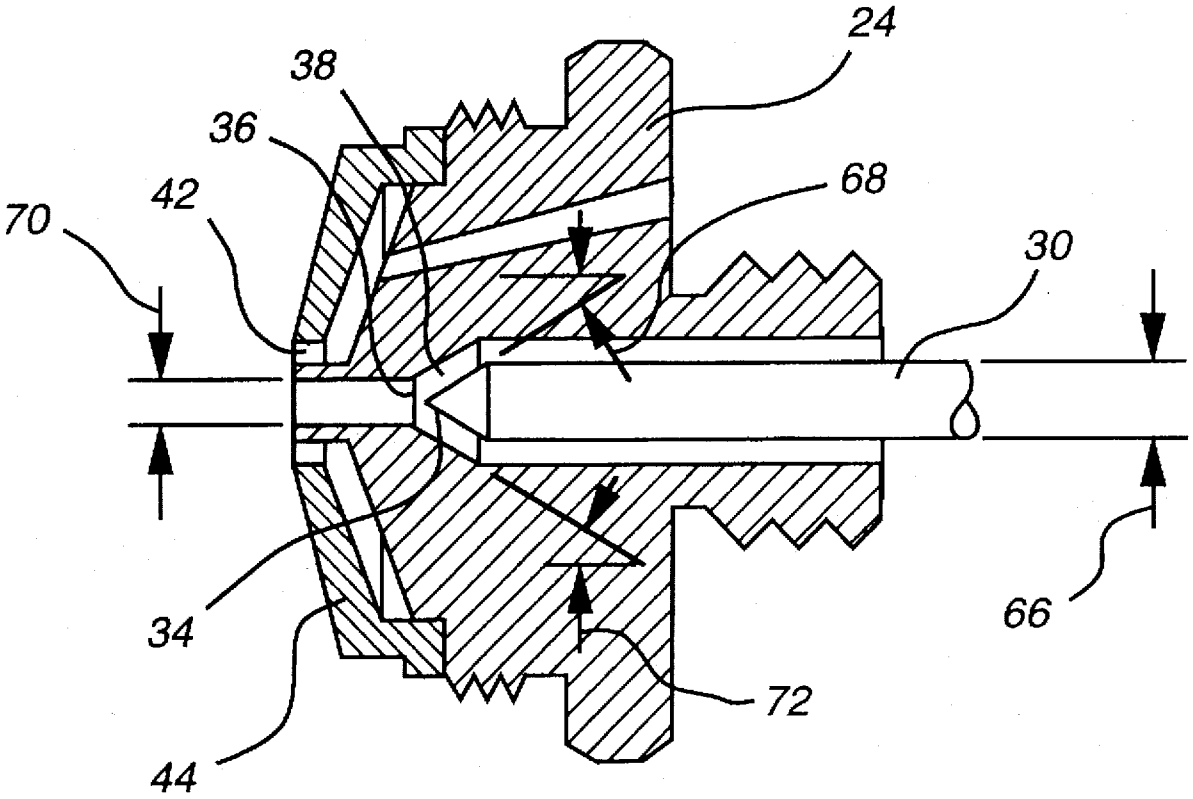
FIG. 3*a* is a cross-sectional view of the control orifice region of the embodiment of the spray shower nozzle of the present invention illustrated in FIG. 3.

Referring now to FIG. 3 and FIG. 3*a*, in a preferred embodiment of the present invention the apparatus 22 includes one air-atomizing water spray nozzle 24 per cross-machine control segment 14, with the water flow applied by each nozzle 24 being metered by an integrated needle 30 that is throttled by a single thermal expansion element 32. The needle's conical point 34 moves axially in and out of a circular orifice 36 when it is pushed or pulled upon by the thermal expansion element 32 which is in the form of a thermally expansive metal tube fabricated of a suitable material such as aluminum or copper.

Movement of the needle's point 34 adjusts the cross-sectional area of the annular throat 38 formed by the confluence of the needle 30 and the circular orifice 36. Adjusting the cross-sectional area of the annular throat 38 meters the flow of water that is forced through it by the water's upstream pressure. The metered water flow is then mixed with a constant, pressurized air stream which is separately introduced by means of an air supply connectors 40. After the metered water flow exits the circular orifice 36, it is mixed with, and atomized by, the high velocity annular air stream that exits through a surrounding annular orifice 42 formed by the mounting of an air cap 44 over the water spray nozzle 24. The high velocity mixture of air and water thus forms an atomized jet 12 which impinges upon the surface of the sheet 16 to be moisturized.

The thermal expansion tube 32 is attached at one end to the threaded adapter 82 which in turn is attached to the needle extension shaft 46, and at the other end to an adapter fitting 48 that is threaded into the nozzle body 50. The expansion tube 32 is heated by a heating element 52 that may be in the form of a sheet wrapped around the expansion tube 32. When the power to the heating element 52 is increased or decreased the expansion tube 32 undergoes incremental expansion or contraction of between 0.005 inches and 0.040 inches, thereby repositioning the needle's point 12 relative to the circular orifice 36 to adjust the water flow.

As described above, the expansion tube 32 is attached to the nozzle body 50, via the adapter 48. The nozzle body 50 is in turn attached to the outer enclosure 28 by the series of components 24, 78 and 80. When the tube 32 is heated, it expands or elongates. The opposite end of the tube 32, furthest from the nozzle body 50 will move away from the nozzle body 50. The opposite end of the tube 32 is also attached via components 82 and 46 to the needle 30. When the opposite end of the tube 32 moves, it will pull the needle 30 along with it, moving the point of the needle away from the control orifice which is located in the nozzle 24, so as to increase the open area of the control orifice to increase the water flow rate. For this reason, it is critical that gasket 84, which is described below, be sufficiently thick and compressible to allow back and forth movement equal to the full desired needle travel distance.

Displacement of the needle's point 34 is preferably about 0.030 inches, using a commercially available nozzle type that includes a shut off needle (which has been modified to permit throttling or intermediate positioning), and this displacement is sufficient to produce a flow rate of 10 GPH, using air and water supplied at pressures in the region of 15 to 20 psig.

With the metal tube shown in FIG. 3, the expansion of about 0.030 inches would be desirable for a temperature rise of 100° Fahrenheit. Aluminum has a thermal expansion coefficient of about $1.3\times10^{-5}$ per degree Fahrenheit. Therefore, to expand the tube 0.030 inches with a 100° Fahrenheit rise, the tube would have to be about 23 inches long. Brass, having a coefficient of $1.0\times10^{-5}$ per degree Fahrenheit, and copper, with a $0.94\times10^{-5}$ per degree Fahrenheit coefficient, would require proportionally longer tube lengths. Aluminum, therefore, is the preferred choice. If a larger orifice diameter is used so that a smaller needle translation is needed, and a bigger heater is used to provide a larger temperature rise, then use of a shorter tube is more feasible. For example, if a 0.010 inch movement is needed rather than a 0.030 inch movement and if the tube is heated to 150°, then the required tube length would only be about 6 inches, as is the case in the embodiment illustrated in FIG. 3.

The nozzle used in the preferred embodiment may be obtained from Spraying Systems Company of Wheaton, Ill. and is sold under the designation "¼ JN" which includes a specific combination of air and fluid caps which produces desired flow rates and atomization levels. In one embodiment, a combination of Spraying System's model 60100 fluid cap and model 67147 air cap is used. When air and water is supplied to such a nozzle assembly having a needle whose threads have been removed so that it can be slid in and out, a needle movement of 0.030 inches (starting from fully closed) results in a water flow rate of about 10 G.P.H. when the air and water are supplied at approximately the same pressure, which is equal to somewhere between 15 and 20 psig (the exact pressure selection depending on a trade-off between atomization levels, air consumption, spray angle, etc.).

Water and air are supplied to each nozzle 24 by common water 54 and air manifolds 56 that span the width of the sheet 16. Water tubing connectors 58 and air tubing connectors 40, and associated tubes 62 and 64, convey water and air to each nozzle 24 from the respective, full-width manifolds 54 and 56.

With appropriate selection of the needle diameter 66 and tip angle 68, the minimum circular orifice diameter 70, and conical angle 72, the length and mass of the expansion tube 32, the wattage of the heating element 52, and the water supply pressure, a suitable flow control range can be achieved with a very small movement of the needle 30. For example, a needle tip angle 68 of 35 degrees, combined with a minimum circular orifice diameter 70 of 1/16 inch, and a circular orifice conical angle 72 of 30 degrees, will, with a 40 psig water supply pressure, permit control of water flow from 0 to 10 gallons per hour, when the needle 30 is moved 0 to 5 thousandths of an inch (i.e. five mils). To achieve an approximate five mil maximum needle movement, a six inch long aluminum expansion tube 32 only needs to be heated up by about 60 degrees Fahrenheit. A thin walled (1/16 inch thick) aluminum expansion tube 32 with a one inch outside diameter 74 can be heated by about 60 degrees Fahrenheit in roughly 80 seconds by a 24 watt heating element 52, assuming that 75 percent of the applied heat is directly absorbed by the expansion tube 32.

The apparatus described above illustrates the basic principles of the present invention. Obvious enhancements can then be made to improve its value in practice. For example, the heater element 52 may be insulated by a wrap-around insulating sheet 74 so that its dissipated heat is efficiently directed into the expansion tube 32, while the expansion tube 32 may remain exposed to the surrounding air to permit it to cool when power to the heating element 52 is reduced. The heating element 52 and heater insulating sheet 74 may be held in place by suitable means, such as by a hand-tightened or screw-tightened clamp 76. Further improvements can also be made to facilitate the total enclosure of the device so as to protect its components from exposure to ambient conditions. The nozzle body 50 can be attached with an adapter fitting 78 and a bulkhead fitting 80 to one side of the apparatus's external enclosure 28. The expansion tube 32 and needle extension shaft 46 may then be threaded onto and into a threaded adapter 82. The threaded adapter 82 may then pass freely through the wall of the external enclosure 28, and be seated against the outside surface of the enclosure 28 by means of a compressible gasket 84. The compressible gasket 84 thus seals the enclosure 28, while permitting sufficient play to absorb the incremental dimensional changes of the expansion tube 32.

Further enhancements can also be made to permit manual adjustment of the water flow. A hand-adjustable knob 86 may be slid over the end of the needle extension shaft 46, and a large-shouldered screw 88 may be threaded into the threaded end of the needle extension shaft 46 to keep the hand-adjustable knob 86 from sliding off. The hand-adjustable knob 86 may be secured in place by a combination of bevel spring washers 90 and an adjustable nut 92. The adjustable nut 92 may be tightened before the needle 30, needle extension shaft 46, and hand-adjustable knob 86 are assembled and threaded into the threaded adapter 82. Torque with which the adjustable nut 92 is tightened may be controlled to provide a suitable friction between the bevel spring washers 90 and the faces of the hand-adjustable knob 86. The hand-adjustable knob 86 can be rotated to screw the needle point 34 into the circular orifice 36 to provide manual control of the water flow. When the hand-adjustable knob 86 is over-tightened the resultant resisting torque will overcome the surface friction between the bevel spring washers 90 and the face of the hand-adjustable knob 86. The hand-adjustable knob 86 may then rotate freely on the needle extension shaft 46 to protect the needle 30 from over-tightening which could cause wear of the needle point 34 and binding of the needle 30 within the circular orifice 36.

Further enhancements can also be made to simplify integration of the spray shower apparatus 10 with the measurement and control computer 20. The required wattage of the heating elements 52 will typically be small enough to permit a supply voltage of 24 or 48 volts, as desired to ensure safe operation in the presence of water. The small heating elements 52 will also draw relatively low amperages (typically 1 amp or less), thereby permitting their control by one or more low-power, electrical interface modules 94 that may preferably be mounted within the apparatus's enclosure 28. 24 or 48 volt power outputs 96 from the electrical interface module(s) 94 may be directly connected to the heating elements 52, while the interface module(s) 94 may also be connected by a suitable computer interface (e.g. a RS485 serial interface) to the measurement and control computer 20 from which water flow setpoints are obtained.

Referring now to both FIG. 1 and FIG. 3, the communications interface 98 between the measurement and control computer 20 and the electrical interface module(s) 94 may preferably use a single, serial communications link, which may be daisy-chained, or multi-dropped, from one interface module 94 to the next (if more than one interface module 94 is required). Each interface module 94 may be designed to control multiple nozzles 24, with hardwire outputs 100 to each control nozzle's heating element 52 being channeled within a suitable cable conduit 102. Each hardwire output 100 may be equipped with a quick-disconnect electrical connector 104, which combined with a heater clamp 76 would permit quick component removal for easier servicing. A single interface module 94 designed to control 16 nozzles 24, each spaced six inches apart, would be sufficient for controlling moisture addition, on a zone-by-zone basis across a 96 inch wide sheet 16. To improve their reliability, the interface module's 94 electronic circuit board(s) and accompanying connectors may be potted within a molded plastic form to provide hermetic isolation from environmental contaminants. If required, the potted package may then be cooled with a through-flow of pneumatic air. Pneumatic air to cool the potted interface module 94 may be conveyed through a separate tube 106 which may be attached by a connector 108 to the pneumatic air manifold 56, and then exhausted from the potted interface module 94 through an adjustable exhaust port 110.

Further enhancements can also be made to improve the industrial packaging of the apparatus. Referring now to both FIG. 2 and FIG. 3, the external enclosure 28 may be designed to include a hinged access door 112 with hand-tightened or screw-tightened door fasteners 114 and compressible door seals or gaskets 116. The external enclosure 28 may also include an adjustable purge air exhaust port 118 through which cooling air exhausted from interface module (s) 94 would be vented to atmosphere. Adjustment of the enclosure's purge port 118 would ensure a positive internal pressure, as needed to keep ambient contaminants out (to reduce the risk of component corrosion). The enclosure's purge port 118 is preferably located in the lower corner of the enclosure 28, to permit drainage to the exterior of any water that might collect within the enclosure 28. Although not shown in the illustrations, a sheet-type heater could also be added to the inside, downward-oriented surface 120 of the enclosure 28, to elevate the enclosure wall temperature so as to evaporate moisture from the enclosure's external surface. This will help to prevent over-spray and ambient humidity from collecting on the outer surfaces of the enclosure 28 and dripping down onto the sheet 16.

Figure 4:
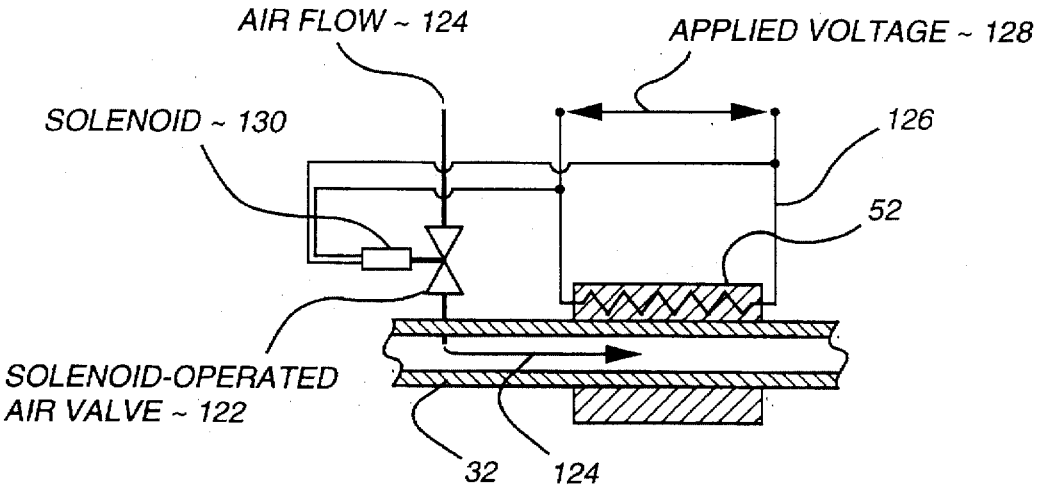
FIG. 4 is a schematic view of an alternate embodiment of the spray shower nozzle of the present invention illustrated in FIG. 3.

The embodiment illustrated in FIGS. 3 and 3*a* may potentially be improved upon by numerous, further enhancements. Referring now to FIG. 4, a representative enhancement would increase the speed of response when power to the heating element 52 is reduced or removed, by adding a small solenoid-operated air valve 122, which would pass air 124 through the center of the expansion tube 32 to more rapidly remove surplus heat. Electrical wiring 126 could be arranged to apply a common supply voltage 128 to both the solenoid-operated air valve 122 and the heating element 52, to avoid the need for an additional control output. The solenoid-operated air valve 122 would preferably be normally-closed, such that when power is applied to the heating element 52 no cooling air would pass through the hollow center of the expansion tube 32. Conversely, when power to the heating element 52 is removed, the solenoid 130 would de-energize, permitting cooling air 124 to pass through the expansion tube 32.

Figure 5:
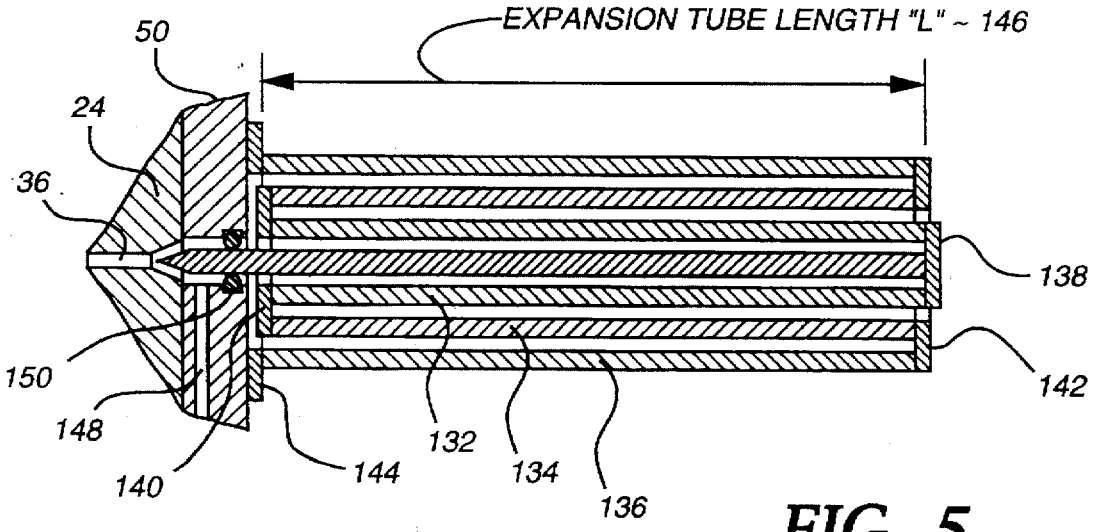
FIG. 5 is a schematic view of still another alternate embodiment of the spray shower nozzle of the present invention illustrated in FIG. 3.

Referring now to FIG. 5, an additional embodiment is shown which uses an expansion tube with multiple walls to increase the range of movement of the flow control needle 30 that is produced by a given temperature change. The embodiment illustrated in FIG. 5 includes a triple-walled tubular arrangement, consisting of an inner tubular element 132 with a high coefficient of thermal expansion, a middle tubular element 134 with a substantially lower coefficient of thermal expansion, and an outer tubular element 136 with a high coefficient of thermal expansion. The flow control needle 30 would be attached to the inside of the upper end 138 of the inner tubular element 132. The middle tubular element 134 would then be attached to the bottom end 140 of the inner tubular element 132, while the outer tubular element 136 would be attached to the upper end 142 of the middle tubular element 134. The bottom 144 of the outer tubular element 136 would then be attached to the nozzle body 50, which in turn would be attached to the water flow nozzle 24 through which the circular orifice 36 is drilled. When the triple-walled tubular arrangement is heated, the expansion tube length "L" 146 will increase, retracting the needle 30 relative to the circular orifice 36 to increase the water flow rate. The water flow would enter the region upstream of the circular orifice 36 through an access channel 148 in the nozzle body 50, and would be prevented from entering the region of the tubular expansion tubes by one or more fluidic seals, such as o-rings 150. The inner tubular element 132 and outer tubular element 136 will both expand substantially more than the middle tubular element 134, resulting in an axial thermal expansion and needle movement which is greater than would be the case with a single-walled tube of length "L", but somewhat less than would be the case with a single-walled tube of length "2L".

Figure 6:
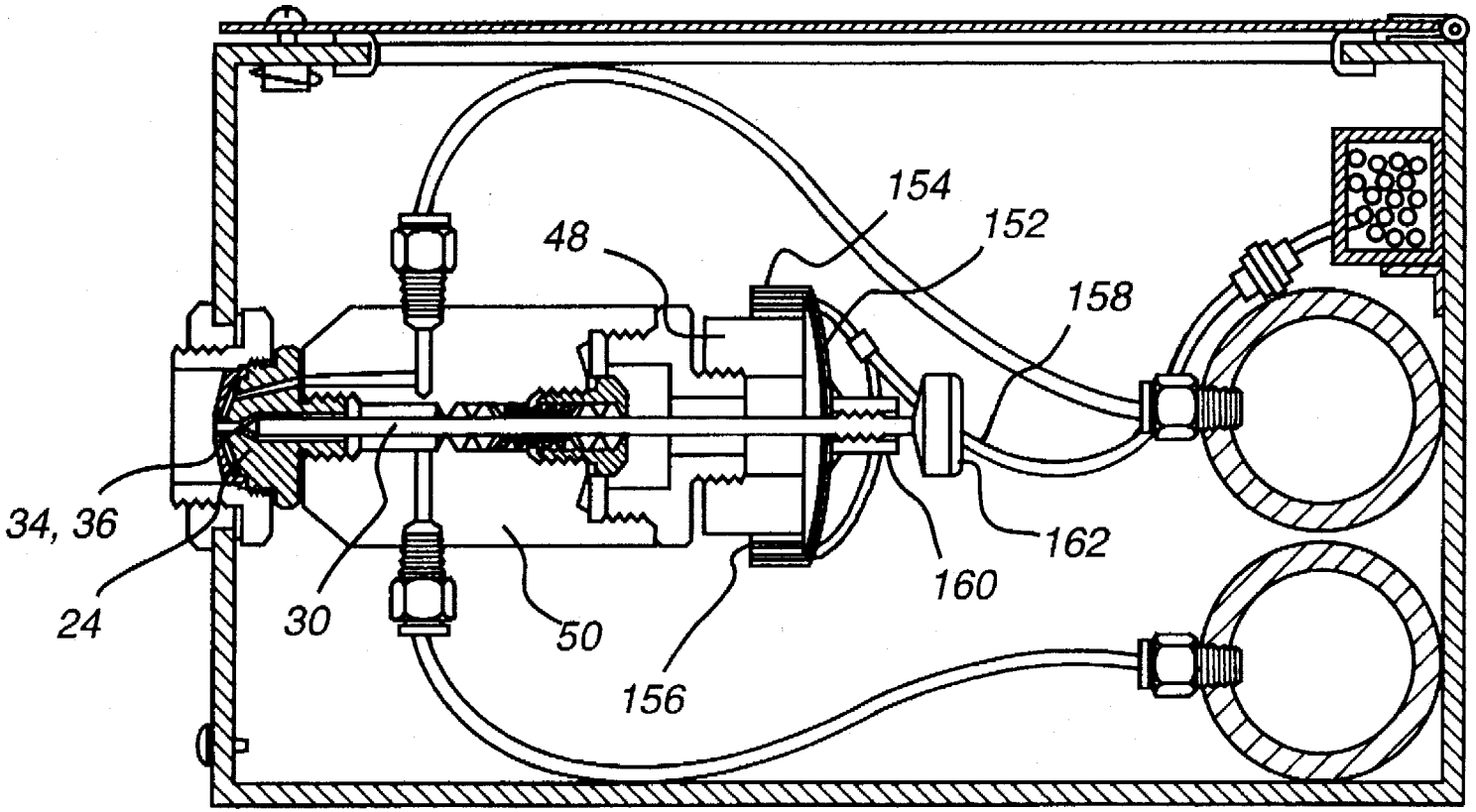
FIG. 6 is a cross-sectional view of another embodiment of the present invention, showing a thermal expansion element in the form of a thermostatic bimetal strip.
Figure 6A:
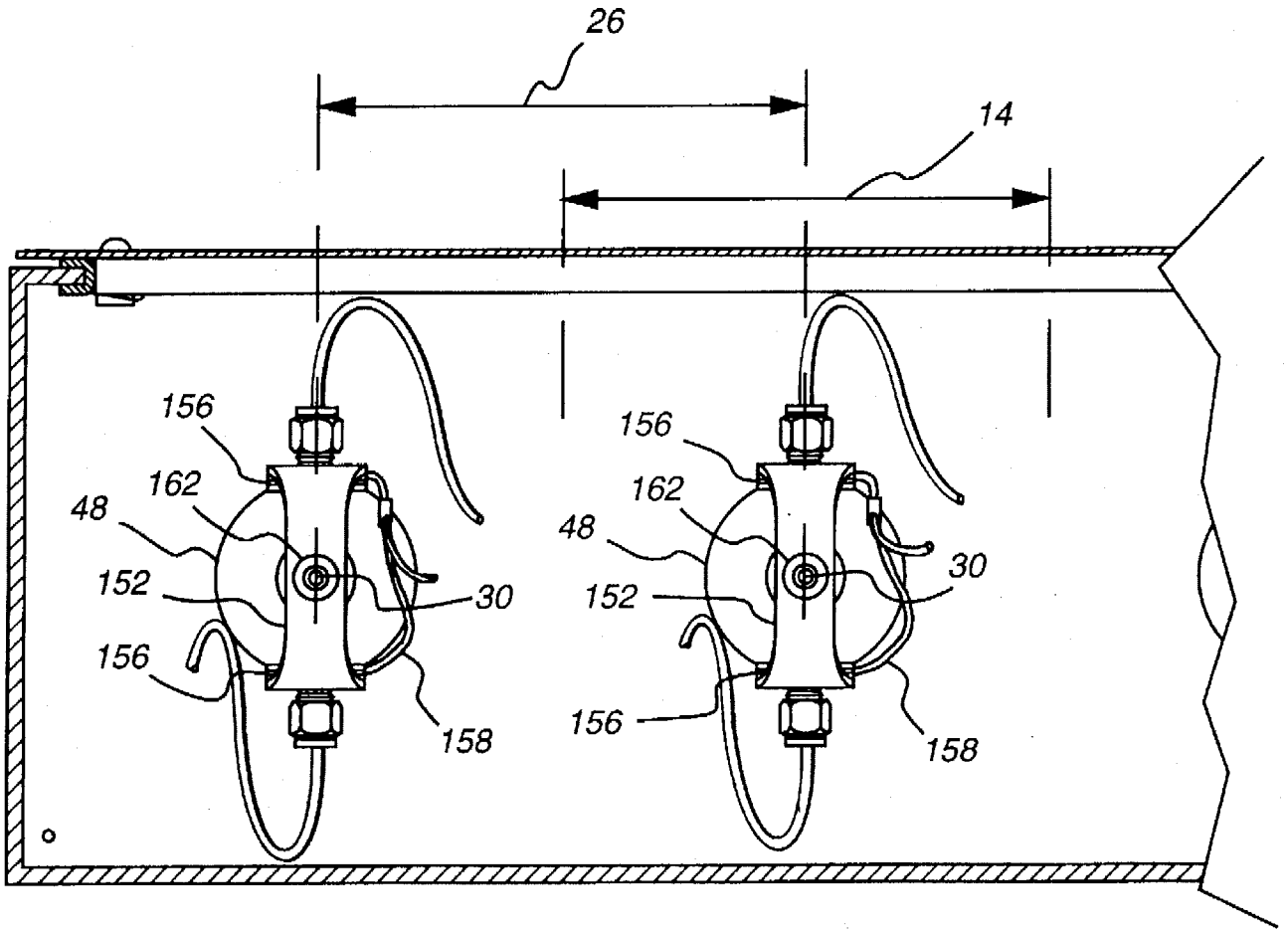
FIG. 6*a* is an elevational view (partly in section) of the embodiment of the spray shower apparatus illustrated in FIG. 6.

Referring now to FIG. 6 and FIG. 6*a* another embodiment of the present invention is shown which incorporates a plurality of air-atomizing water spray nozzles 24, having a distance 26 between each equal to a cross-machine control segment 14, with the water flow applied by each nozzle 24 being metered by an integrated needle 30 that is throttled by a single bimetal expansion element 152. The needle's conical point 34 moves axially in and out of a circular orifice 36 when it is pushed or pulled upon by the bimetal expansion element 152 which is manufactured from a suitable material, such as type B1 bimetal alloy manufactured by Texas Instrument in Attleboro, Mass.

The bimetal is made of two alloy layers bonded together. The thermal expansion coefficient of one of the alloy layers is larger than the thermal expansion coefficient of the other so that when the composite strip is heated or cooled, each side of the two-layer strip tries to expand or contract a different amount. The differential expansion or contraction causes the strip to bow until the forces in both directions are balanced. At that point, one side will be in compression and one in tension when stability is reached. The stability point will, of course, depend on the final temperature.

In the B1 metal alloy manufactured by Texas Instruments, there are two steel alloys, the first being referred to by Texas Instruments as Alloy B which is a high-expansion alloy consisting of 20% Nickel and 80% Invar (pure iron). The second alloy, Alloy 10 is the low expansion alloy consisting of 30% Nickel and 70% Invar.

A strip of the B1 material which is 2.5 inches high, 1 inch wide and 0.030 inches thick, will bow and exhibit an incremental displacement at the center of the strip relative to the strip's ends of about 0.042 inches when it is heated incrementally by 100° Fahrenheit. Alternatively, if the strip is incrementally heated by 100°, but is not allowed to bow, then it will exert a reaction force of about 7.2 pounds about its central axis. In the present application, moving the needle will require some force, so that the actual maximum displacement of the needle will be approximately 0.030 inches.

In the illustrated embodiment, the bimetal element 152 is shaped as a vertically-oriented strip oriented substantially parallel to the sheet 16, symmetrically located so as to avoid side-loading of the needle 30. When the bimetal element 152 is heated it bows further away from the nozzle's circular orifice 36, pulling the needle 30 back to increase the water flow.

The ends of the bimetal element 152 are bent over to form tabs 154 which are bonded to the flat surface of thermo-electric cooling devices 156, one of which is located on either end of the bimetal element 152. The thermo-electric cooling devices 156 are in turn bonded to flat surfaces machined into an adapter fitting 48 which threads onto the nozzle body 50. To prevent side-loading of the needle 30, the two thermo-electric cooling device 156 are wired 158 in parallel to ensure simultaneous, symmetrical heating or cooling of both ends of the bimetal element 152. The needle's 30 shaft is threaded and screwed into a threaded boss 160 which in turn is welded to the bimetal element 152.

The thermo-electric cooling devices 156 may be oriented such that when the electrical polarity applied to them is positive, they pump heat from the bimetal element 152 into the nozzle body 50, so as to actively cool the bimetal element 152 and pull upon the needle 30. Conversely, when the electrical polarity applied to the thermo-electric cooling devices 156 is reversed, the thermo-electric cooling devices 156 pump heat from the nozzle body 50 into the bimetal element 152, so as to actively heat the bimetal element 152 and push upon the needle 30. In this manner, reversing the electrical polarity applied to the thermo-electric cooling devices 156 causes the bimetal element 152 to move the needle 30 in the opposite direction. The direction of electrical polarity, and the duration of its application, can thus be controlled to drive the needle 30 to a desired rest position, as needed to produce a desired water flow rate. When the bimetal element 152 is fully cooled, a manual adjustment knob 162 on the end of the needle 30 may be screwed in to shut-off the water flow and therefore to "zero" the flow control range.

Figure 7:
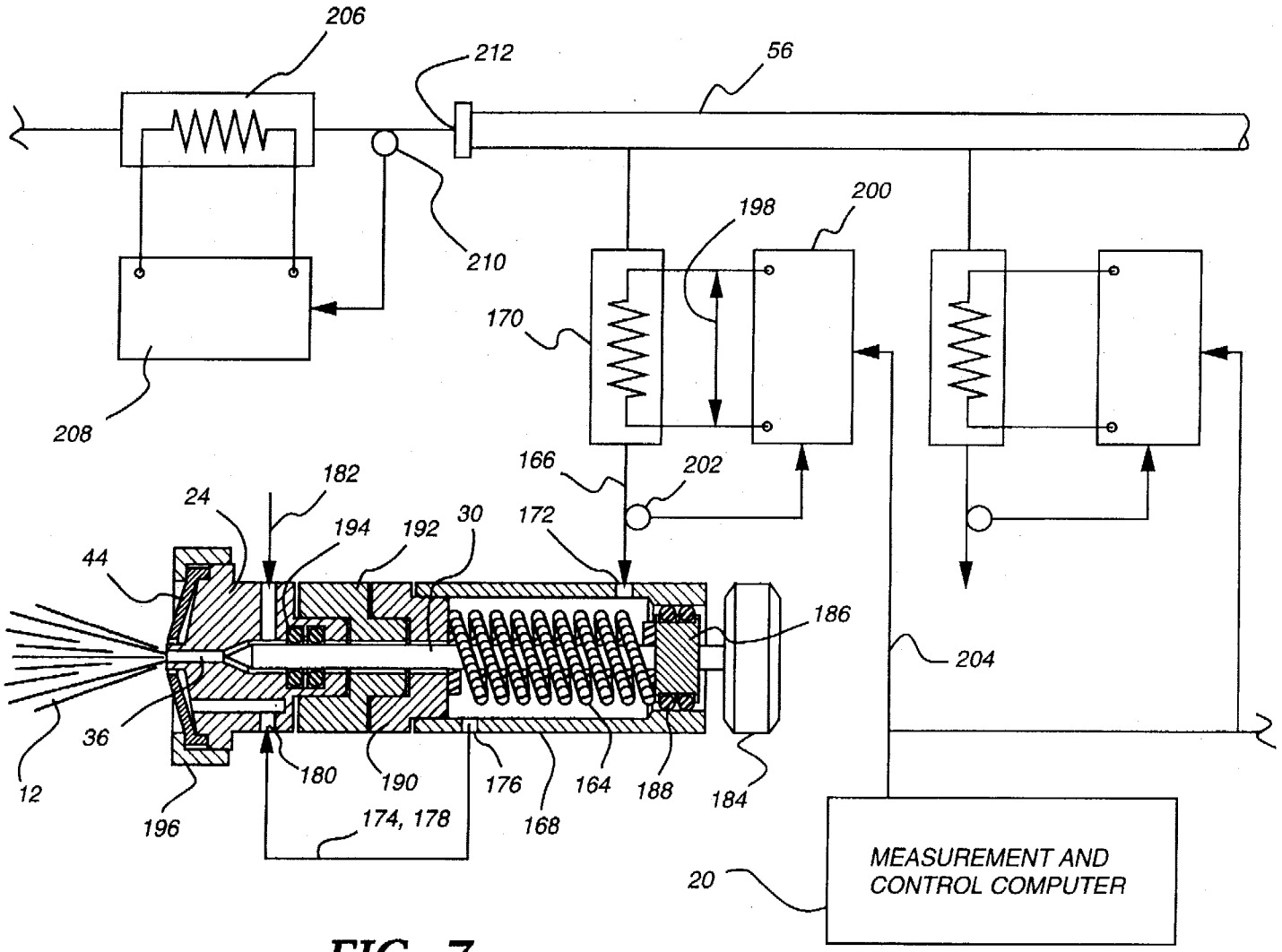
FIG. 7 is an schematic view of another embodiment of the invention, which uses a thermostatic, bimetal element shaped into a double helix.

Referring now to FIG. 7, another embodiment of the present invention is shown which incorporates a plurality of air-atomizing water spray nozzles 24, whose water flow is metered by an integrated needle 30 that is throttled by a single bimetal expansion element 164. The embodiment illustrated in FIG. 7 uses a bimetal element 164 in the shape of a double-helix that surrounds the flow control needle 30. When incrementally heated or cooled the bimetal element 164 will exert an axial force that pulls or pushes upon the needle 30. As in the case of the embodiments described above, the embodiment illustrated in FIG. 7 uses a simple contacting heating element, or one or more thermo-electric coolers, to produce relative expansion or contraction of the bimetal element 164. The apparatus may also use a flow of air 166 of controlled initial temperature, to indirectly heat or cool the bimetal element 164. The bimetal element 164, which is in the form of a double-helix, and has an overall tubular shape, may be surrounded by an air-tight sleeve 168, which is preferably made of material with thermal suitable material with thermal insulating characteristics. The air flow 166, which is previously heated by a upstream air heater 170, then enters the sleeve 168 through the air connection port 172, and conveys heat to the bimetal element 164 by means of forced convection, prior to exhausting as a spent air flow 174 from the sleeve's exhaust port 176. The spent air flow 174 may then be channeled by a suitable complement of connectors and tubing 178 to the nozzle's air inlet port 180 where it may be mixed with the metered water flow 182 to generate the atomized spray jet 12.

The embodiment illustrated in FIG. 7 shares a number of aspects common to the embodiments described in FIGS. 3, 3*a*, 6 and 6*a*. Referring again to FIG. 7, the needle 10 includes a hand-adjustable knob 184, and is threaded through the center of a sealing piston 186 which slides inside the sleeve 168. The sealing piston 186 incorporates suitable sealing means, such as o-rings 188, as needed to keep the pressurized air flow 166 from leaking to ambient.

The bimetal element 164 is joined at one end by suitable means, such as by welding or brazing, to the inside face of the sealing piston 186, and at the other end, by a similar or identical joining method, to the inside face of a threaded adapter fitting 190, onto which the sleeve 168 is also threaded. The threaded adapter fitting 190 is then threaded onto a plastic adapter 192, which is in turn threaded onto the nozzle 24. The plastic adapter 192 thermally insulates the metallic threaded adaptor 190 from the metallic nozzle 24, thereby reducing the response time of the bimetal element 164 by reducing heat losses to the nozzle. The nozzle 24 is also designed to include a suitable needle sealing means, such as o-rings 194, as needed to prevent pressurized water 182 from leaking back into the region of the bimetal element 164.

An air cap 44 is mounted over the front of the nozzle 24, and held in place with a hand-tightened nut 196 that threads onto the outside diameter of the nozzle 24. When the initial temperature of the air flow 166 is raised by increasing the power or voltage 198 applied to the upstream air heater 170, the bimetal element's 164 temperature is indirectly raised. Raising the bimetal element's 164 temperature causes it to expand, thereby pushing on both the threaded adapter 190 and the movable sealing piston 186. The sealing piston 186 is thus moved relative to the sleeve 168 and nozzle 24, thereby pulling back on the needle 30 to increase the metered water flow 182. Conversely, when the air flow's 166 initial temperature is reduced, the bimetal element 164 contracts, allowing the needle 30 to move closer to the circular orifice 36 to reduce the metered water flow 182.

To provide accurate, closed-loop control, as well as device diagnostics, the air heater 170 is controlled using a computer-based temperature controller 200 and a downstream temperature feedback sensor 202, such as a thermocouple, thermistor, or RTD. The temperature controller 200, which typically accommodates more than one nozzle control loop, receives its temperature setpoint(s) from a measurement and control computer 20 by suitable means, such as a serial communications link 204. The measurement and control computer 20 increments or decrements temperature setpoints as needed to produce the desired moisture application rates for each cross-direction control segment. To ensure that all nozzles 24 deliver zero water flow 182 when power 198 to their respective air heaters 170 is shut off, the initial air supply temperature is controlled, by means of a heater 206, computer-based temperature controller 208, and a downstream temperature feedback sensor 210 (such as a thermocouple, thermistor, or RTD), to a constant value at the inlet 212 to the common, full-width, air manifold 56.

Figure 8:
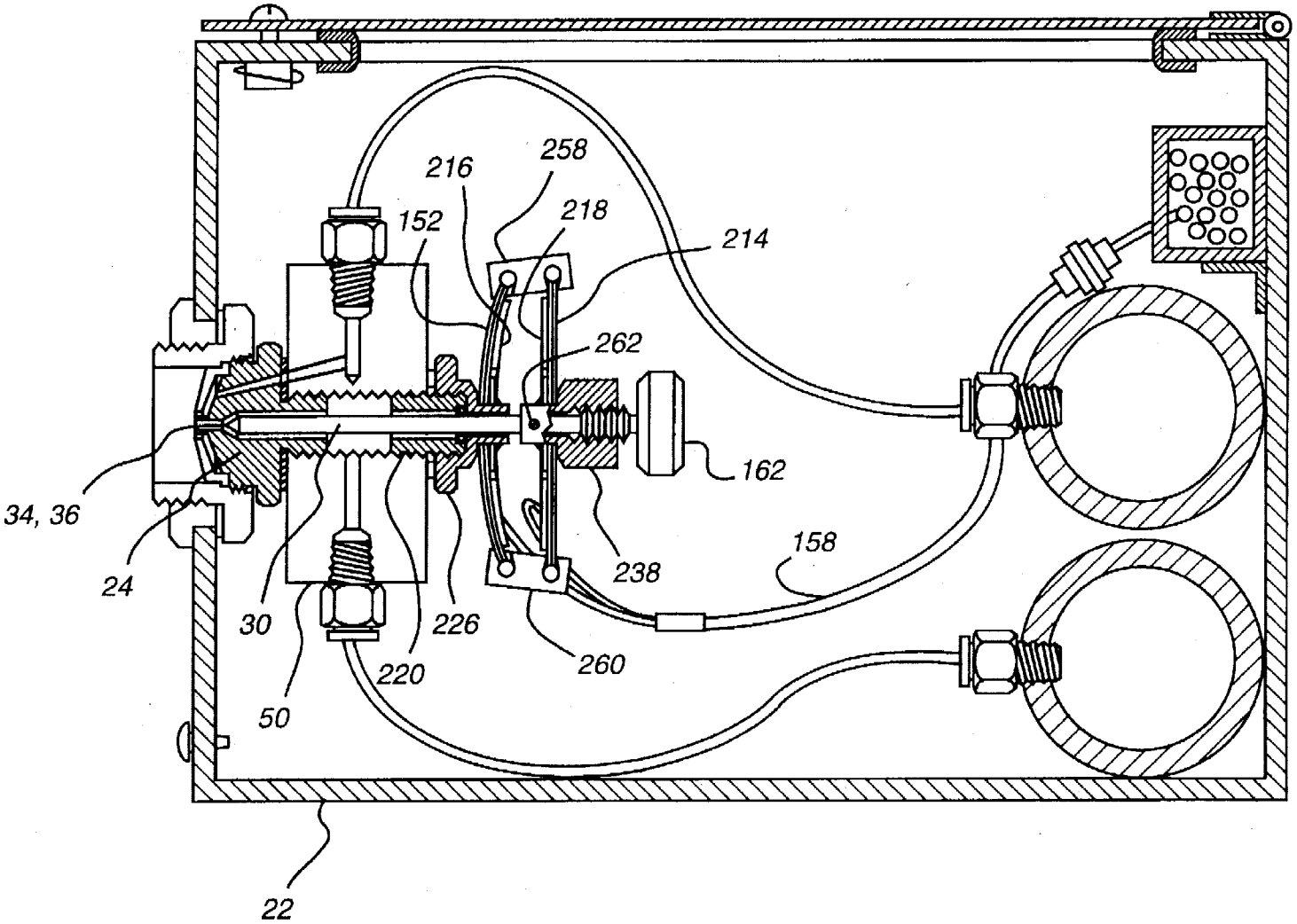
FIG. 8 is a cross-sectional end-view of another embodiment of the spray shower apparatus of the present invention, showing two electrically-heated, adjacent bimetal elements that oppose one another to compensate for ambient temperature changes.
Figure 8A:
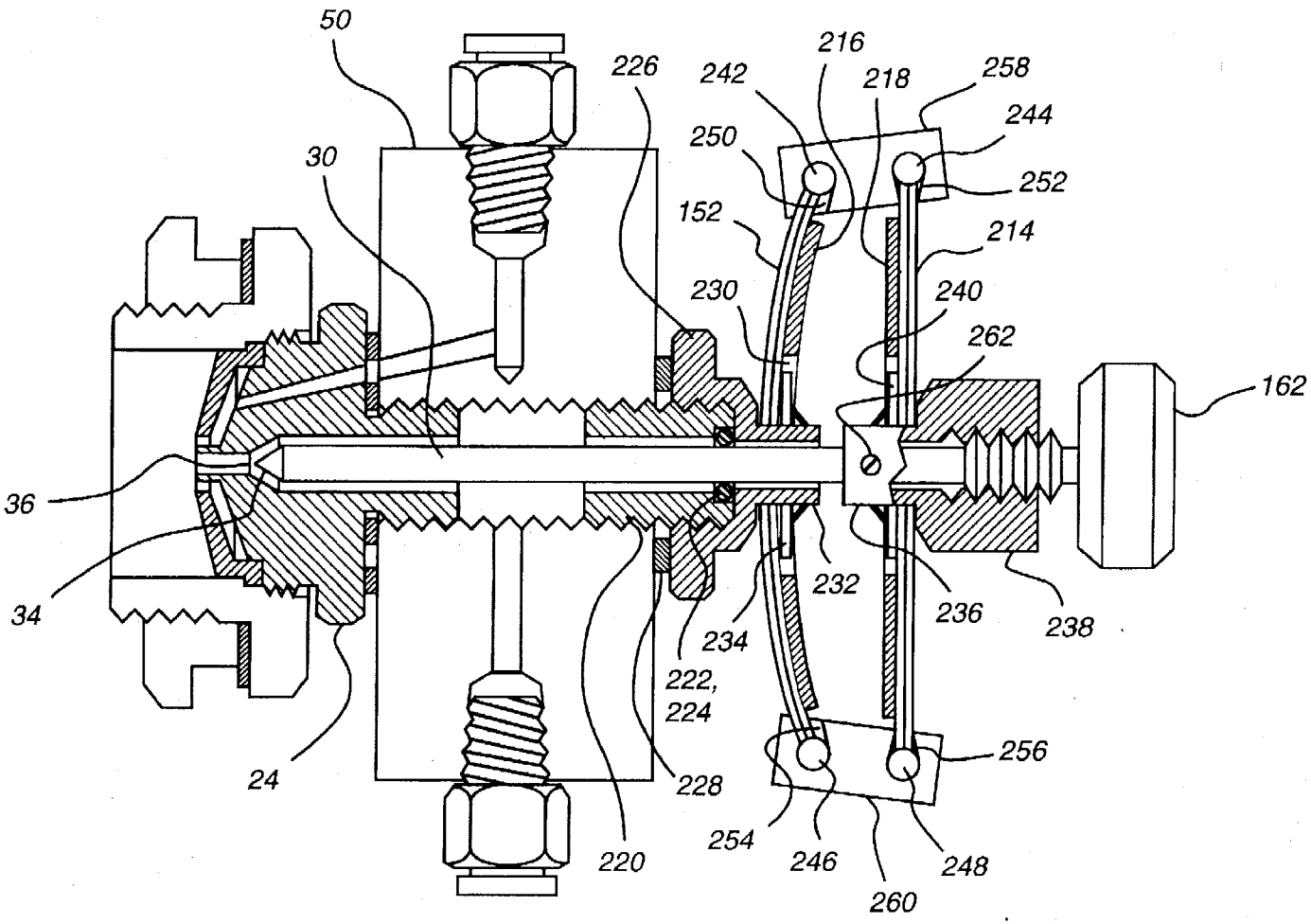
FIG. 8*a* is another cross-sectional end-view of the assembled primary components of the spray shower apparatus shown in FIG. 8.

Referring now to the preferred embodiment illustrated in FIGS. 8 and 8*a*, the apparatus includes two (2) bimetal expansion elements 152 and 214. Both bimetal elements 152 and 214 are oriented such that when heated they will bow in the same direction. The two bimetal elements 152 and 214 are also attached to the nozzle body 50 and needle 30 in such a way that when the bimetal element 214 is heated it will cause the needle's conical point 34 to move further into the circular control orifice 36 to reduce the water flow. When the other bimetal element 152 is heated it will cause the needle's conical point 34 to move away from the circular control orifice 36 to increase the water flow. Ambient temperature changes will affect the two bimetal elements 152 and 214 equally, producing equal and opposite movements of the needle 30 that cancel out. Using two counteracting bimetal elements 152 and 214 therefore ensures that the position of the needle's conical point 34 relative to the circular control orifice 36 is independent of ambient temperature.

The two bimetal elements 152 and 214 are rectangular and oriented perpendicular to the axis of the nozzle 24 and needle 30. One, or both, of the bimetal elements 152 and 214 is heated with foil-type heaters 216 and 218 that are bonded to the exterior surfaces of the bimetal elements 152 and 214 using a pressure-sensitive adhesive. In a suitable implementation both bimetal elements 152 and 214 are 2.5 inches long, 1 inch wide, and 0.030 inches thick, and are manufactured from material B1 supplied by Texas Instrument of Attleboro, Mass., prior to being suitably plated (i.e. with chrome or tin) to render them corrosion-resistant. The heaters 216 and 218 are then selected to raise the temperature of the bimetal elements 152 and 214 by adequate amounts in a suitable time increment. Depending upon numerous criteria, such as the required maximum needle travel, the chosen dimensions of the circular control orifice 36 and the needle's conical point 34, as well as the desired response time, the required heater wattage will typically range from 5 to 20 watts. For example, to produce a needle travel of 40 mils (0.040 inches) in less than one minute by heating only one bimetal element 152, given the bimetal element dimensions noted above, the temperature of the bimetal element 152 must be increased by about 100 degrees Fahrenheit with a 10 watt heater 216. It is also preferable to power the heaters 216, 218 with low voltage (i.e. from 0 to 48 volts) to ensure intrinsically safe operation in the event of a water leak. Therefore, when the heaters 216, 218 are wired through wires 158 to a 24 volt power supply, the required heater resistance will typically fall between 28 and 115 ohms, as required to dissipate a maximum of 5 to 20 watts per heater. Suitable foil-type heaters 216, 218 may be obtained from numerous sources, such as Minco Products Incorporated, in Minneapolis. Suitable heaters 216, 218 supplied by this company consist of a resistor element bonded between layers of Kapton sheet, and may be securely bonded to the bimetal elements 152, 214 with #12 PSA adhesive.

The operation of the apparatus 22 shown in FIGS. 8 and 8*a* will now be described. A threaded cylindrical nipple 220 is screwed into the simplified nozzle body 50, and a small o-ring 222 (i.e. 0.125 inch internal diameter and 0.25 inch external diameter), which is made from a low friction material such as silicone, is then pushed into an internal recess 224 in the end of the nipple 220. A plastic, cylindrical mounting bushing 226 is then threaded onto the nipple 220, and tightened until it captures and slightly compresses the small o-ring 222 set inside the end of the nipple 220. The tightened mounting bushing 226 also compresses a sealing gasket 228 against the surface of the nozzle body 50. The heater 216, which has a circular hole 230 through its center, is bonded to the surface of the bimetal element 152 which has a smaller hole through its center. The bimetal element 152 is then slid over the smooth, cylindrical shoulder 232 of the mounting bushing 226. A serrated washer 234, having a slightly smaller internal diameter than the external diameter of the mounting bushing's shoulder 232, and a smaller outside diameter than the inside diameter of the hole in the foil heater 216, is then pushed over the outside of the shoulder 232 to fasten the first bimetal element 152 onto the mounting bushing 226.

The second bimetal element 214, which also has a circular hole through its center, is then slid over the smooth, cylindrical shoulder 236 of a second plastic bushing 238. A second serrated washer 240 is then slid over the shoulder 236 of the second bushing 238 to fasten the second bimetal element 214 onto the second bushing 238. The threaded needle 30 is then screwed through the second bushing 238, and slid into the nozzle body 50. Both bushings 226 and 238 are made from a suitable plastic, such as Delrin or Teflon, to thermally insulate the bimetal elements 152 and 214 from the metallic nipple 220 and needle 30.

The two bimetal elements 152 and 214 are then aligned with one another, and then by means of cylindrical pins 242, 244, 246 and 248 welded across their ends, snapped into cross-wise tear-dropped shaped channels 250, 252, 254 and 256 machined into plastic saddles 258 and 260. The plastic saddles 258 and 260 serve to attach one bimetal element 152 to the other element 214 at both ends, while thermally insulating one element 152 from the other element 214, and allowing both to bend freely.

Two control circuit variants may be used to affect the expansion of the bimetal elements 152 and 214 as required to control the position of the needle's conical point 34 relative to the circular control orifice 36. The simplest approach allows only the bimetal element 152 located next to the nozzle body 50 to be heated, while the second bimetal element 214 is unheated. In this embodiment, the heater 218 that is shown bonded to the second bimetal element 214 is not required. With this simple approach the single heater 216 is supplied with variable power by either varying the supply voltage from typically 0 to 24 volts, or by holding the supply voltage constant (typically 24 volts) while varying the time that it is applied. In either case, the single heater 216 has an electrical resistance which is chosen to dissipate the required maximum quantity of heat per unit of time when the chosen maximum voltage is applied across it. In a suitable implementation the voltage is varied from 0 to a maximum of 24 volts, and the heater's electrical resistance is 48 ohms, producing a maximum heat dissipation rate, and control range, of 12 watts, with the average heat dissipation through a plurality of nozzles 24 and associated heaters 216 being typically half of that, or 6 watts per heater 216.

Upon initial installation of the apparatus 22, voltage to the heater 216 is set to zero, and the needle 30 is manually screwed in, using the manual adjustment knob 1629 on its end to fully close the circular control orifice 36. A set screw 269. which is threaded into the second bushing 238 is then tightened to lock the position of the needle 30 relative to the second bushing 238. When voltage is applied across the heater 216, the temperature of the bimetal element 259. is increased above ambient, causing it to bow away from the nozzle body 50. The ends of the heated bimetal element 152. then push on the ends of the unheated bimetal element 214, which in turn pulls back on the second bushing 238 to slide the needle's conical point 34 away from the circular control orifice 36. When the voltage applied across the heater 216 is subsequently decreased, reduced heat dissipation allows the bimetal element 152 to cool, causing it to straighten. The ends of the bimetal element 152 then pull back on the ends of the unheated bimetal element 214, which in turn pushes on the second bushing 238 to slide the needle's conical point 34 toward the circular control orifice 36.

Figure 8B:
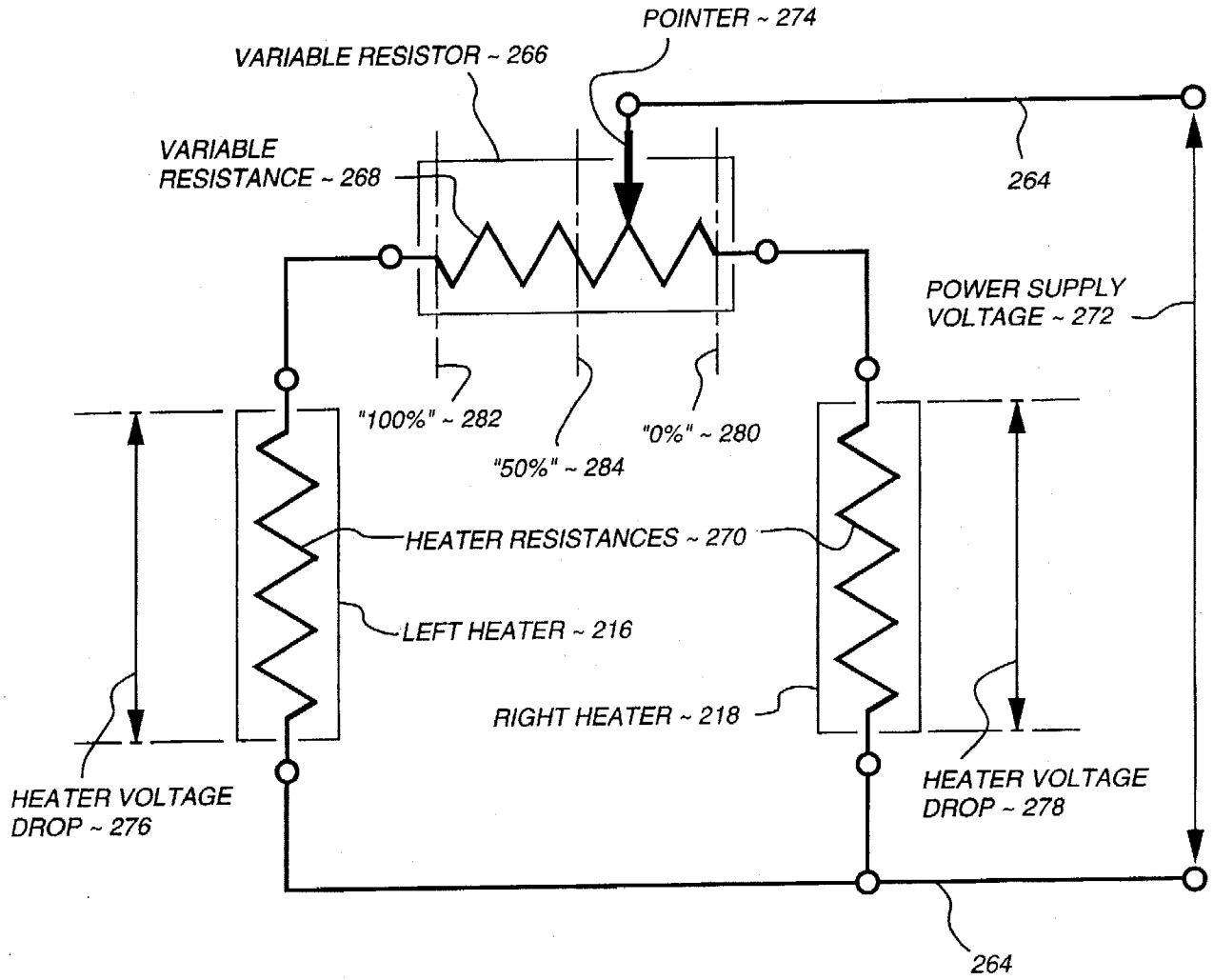
FIG. 8*b* is a schematic illustration of a heater control circuit for use with the spray shower apparatus shown in FIGS. 8 and 8*a*.

Referring now to FIGS. 8, 8*a*, and 8*b*, an alternative, more complex heater circuit may be utilized that allows both bimetal elements 152 and 214 to be heated by foil-type heaters 216 and 218. For the purpose of illustration, the heater 216 which is bonded to the bimetal element 152 located nearest the nozzle body 50 shall be referred to as the left heater 216, while the heater 218 which is bonded to the other bimetal element 214 shall be referred to as the right heater 218. The heater control circuit 264 for this embodiment of the invention includes a variable resistor 266 whose electrical resistance 268 is twice the electrical resistance 270 of each of the heating elements 216 and 218 (i.e. the left heater 216 and right heater 218 have the same electrical resistance). The power supply voltage 272 applied across the circuit 264 is held constant, while the position of the variable resistor's pointer 274 is moved to adjust the voltage drops 276 and 278 across each of the heaters 216 and 218. The variable resistor 266 thus alters the percentage of the total power consumption that is dissipated by each heater 216 and 218. The variable resistor 266 may be of a simple analog type (i.e. a potentiometer) to allow manual adjustment from a remote-manual input panel, or part of an integrated-circuit that allows heater operation to be automated by a control computer.

A specific example will now be described to help clarify the operation of this heater control circuit 264. In a suitable implementation the power supply voltage 272 is 24 volts, the heater resistances 270 are both 48 ohms, and the variable resistance 268 is 96 ohms. When the variable resistor's pointer 274 is positioned at position "0%" 280, the voltage drop 276 across the left heater 216 is 8 volts, producing a heat dissipation rate of 1.33 watts in the left heater 216 (i.e. $8^2/48=4/3$). The remaining 16 volt drop (i.e. 24−8=16) across the variable resistor 266 produces a heat dissipation rate in the variable resistor 266 of 2.67 watts. Simultaneously, the full 24 volt drop 278 across the right heater 218, produces a heat dissipation rate of 12 watts in the right heater 218 (i.e. $24^2/48=12$). The difference between the heat dissipation rates in the two heaters 216 and 218 produces a 10.67 watt (i.e. 12−1.33=10.67) imbalance that favors the right heater 218.

When the variable resistor's pointer 274 is re-positioned to position "100%" 282, the voltage drop 278 across the right heater 218 drops to 8 volts, producing a heat dissipation rate of 1.33 watts in the right heater 218. The remaining 16 volt drop (i.e. 24−8=16) across the variable resistor 266 maintains the heat dissipation rate in the variable resistor 266 at 2.66 watts. Simultaneously, the full 24 volt drop 276 across the left heater 216 produces a heat dissipation rate of 12 watts in the left heater 216 (i.e. $24^2/48=12$). The difference between the heat dissipation rates in the two heaters 216 and 218 now produces a 10.67 watt imbalance that favors the left heater 216.

When the variable resistor's pointer 274 is centered at position "50%" 284, the voltage drops 276 and 278 across each of the heaters 216 and 218 equals 12 volts, producing an equal heat dissipation of 3 watts (i.e. $12^2/48=3$) in both of the heaters 216 and 218. Simultaneously, each half of the variable resistor 266 bears the remaining 12 volt drop (i.e. 24−12=12), resulting in a total heat dissipation in the variable resistor 267 of 6 watts (i.e. $2\times12^2/48=6$). Total power consumption in the heater control circuit 264 therefore varies from a minimum of 12 watts (i.e. 3+3+6=12) when the variable resistor's pointer 274 is centered at position "50%" 284, to a maximum of 16 watts (i.e. 1.33+12+2.66=16) when it is moved to either position "0%" 280 or position "100%" 282. The effective control range is therefore 21.33 watts (i.e. [12−1.33]+[12−1.33]=21.33), while the average power consumption with a plurality of nozzles 24 and associated heaters 216, 218 is typically 12 watts per pair of heaters 216, 218.

Upon initial installation of the apparatus 22 employing the heater control circuit 264 illustrated in FIG. 8*b*, the variable resistor's pointer 274 is positioned to position "0%" 280, causing 8 more watts to be dissipated through the right heater 218 than through the left heater 216. The bimetal element 152 located nearest the nozzle body 50 then bows slightly away from the nozzle body 50, while the bimetal element 214 nearest the manual adjustment knob 162 bows significantly more towards the nozzle body 50. The needle 30 is then manually screwed in, using the manual adjustment knob 162 to fully close the circular control orifice 36. The set screw 262 threaded into the second bushing 238 is then tightened to lock the position of the needle 30 relative to the second bushing 238. When the variable resistor's pointer 274 is moved toward position "100%" 282, the temperature of the bimetal element 214 located nearest the manual adjustment knob 162 drops, causing it to straighten, while the bimetal element 152 located nearest the nozzle body 50 is incrementally heated, causing it to bow further away from the nozzle body 50. The ends of the bimetal element 152 located nearest the nozzle body 50 then push on the ends of the straightened bimetal element 214, which in turn pushes on the second bushing 238 to slide the needle's conical point 34 away from the circular control orifice 36.

Heating only one bimetal element 152 has a number of advantages, including a reduction in cost and the number of active components that may fail, simplification of the heater control circuitry 264, fail-closed operation (if power is removed the needle's conical point 34 closes off the circular control orifice 36), and a slightly lower average power consumption required for a given control range (i.e. 6 watts/12 watts, which equals 50%, versus 12 watts/21.33 watts, which equals 56%, for the dual-heater configuration illustrated in FIG. 8*b*). The main disadvantage of heating only one bimetal element 152 is that incremental movement of the needle 30 is produced more rapidly when the heating rate is increased than when it is decreased. This is because when the power to the heater 216 is reduced the bimetal element 152 must dissipate surplus internal energy to the surrounding environment through passive means that include radiation and natural convection, as well as indirect conduction to the nozzle body 50. Another disadvantage of using only one bimetal element 152 is that a higher bimetal element temperature must be achieved to produce a given movement of the flow control needle 30.

By comparison, heating both bimetal elements 152, 214, as illustrated in FIG. 8*b*, provides a more uniform rate of needle movement in both directions, because while the heat input to one bimetal element 152 or 214 is being decreased, the heat input to the other bimetal element 152 or 214 is being increased. In addition, heating two bimetal elements 152, 214 with the control circuit 264 described in FIG. 8*b* increases the control range by 78% (i.e. 21.33/12=1.78), without requiring higher maximum bimetal element temperatures (i.e. in the above examples each bimetal element 152 and 214 is heated with a maximum of 12 watts regardless of whether a single or dual-heater approach is used). In practice, either heater control strategy may be used depending upon the priorities of the specific application. For applications where maximized range and equal bi-directional response time is desired (applications where frequent, and significant changes in water flow rate are required), the dual-heater method illustrated in FIG. 8*b* is preferred. For all other applications the simpler method that heats only one bimetal element 152 is preferred.

While the foregoing invention has been described with respect to its preferred embodiments, various alterations and modifications will occur to those skilled in the art. For example, alternative feedback methods may be employed, such as needle 30 or expansion element 32, 152, 164, 214 position sensing, to improve flow control precision and response time. An appropriate position sensing technique would use a position sensitive transducer such as a linear displacement sensitive transducer, which could be attached at one end to the moving needle 30 or the expansion element 32, 152, 164, 214 and at the other to a fixed reference surface such as the face of the nozzle 24 or nozzle body 50. By way of further example, the expansion elements 32, 152, 164, 214 used to move the flow control needles 30 could be heated by passing electrical current directly through them. This approach would eliminate the need for heating elements 52, thermo-electric coolers 156, or variable temperature air flows 166, to reduce cost and improve reliability. To implement this approach, expansion element materials would be selected based upon their electrical resistivity, as well as their thermal expansivity and specific heat. All such alterations and modifications are intended to fall within the scope of the appended claims.

What is claimed is:

1. A spray shower apparatus for use in application of moisture to a moving sheet of fibrous material such as paper or converted paper products, said apparatus comprising:

a nozzle housing;

a nozzle outlet through which a moisture spray is discharged from the nozzle housing;

control means for controlling flow of moisture through said nozzle outlet, said control means including:

a thermal expansion element which expands when heated and contracts when cooled or when heat applied is reduced, said thermal expansion element being connected to a shaft for causing said shaft to move to control the flow of the moisture spray out of said nozzle outlet upon the expansion and contraction of said thermal expansion element;

a heating element in contact with said thermal expansion element for heating said thermal expansion element.

2. The spray shower apparatus of claim 1 further comprising:

a needle valve mounted in said nozzle housing, said needle valve having a conical tip and wherein said shaft is a needle positioned in said needle valve to allow said needle to pass at least partly through an upstream flow control orifice which leads to said nozzle outlet.

3. The spray shower apparatus of claim 2 wherein said thermal expansion element is a tubular body that is positioned around said needle so that the longitudinal axis of said needle is parallel to the longitudinal axis of said tubular body.

4. The spray shower apparatus of claim 1 wherein said heating element is a second tubular body that surrounds at least a portion of the exterior surface of said thermal expansion element.

5. The spray shower apparatus of claim 1 wherein said thermal expansion element is fabricated from copper.

6. The spray shower apparatus of claim 2 wherein said thermal expansion element is fabricated from aluminum.

7. The spray shower apparatus of claim 1 further comprising:

an annular orifice surrounding said nozzle outlet;

means for supplying a high velocity annular air stream through said annular in a direction which enables said high velocity air stream to mix with the moisture spray discharged through said nozzle outlet.

8. The spray shower apparatus of claim 1 wherein said heating element is surrounded on its exterior surface by an insulating sheet.

9. The spray shower apparatus of claim 1 further comprising a solenoid operated air valve which is positioned to release air through the center of the thermal expansion element to more rapidly remove surplus heat.

10. The spray shower apparatus of claim 3 wherein said expansion element is a series of concentric tubular bodies.

11. The spray shower apparatus of claim 10 wherein at least two of said tubular bodies have different coefficients of thermal expansion.

12. The spray shower apparatus of claim 1 wherein said thermal expansion element is a strip of thermally expansive material which is symmetrically located at one end of said nozzle housing.

13. The spray shower apparatus of claim 12 wherein said thermal expansion element is fabricated out of a bimetal alloy.

14. The spray shower apparatus of claim 12 further comprising a tab located at each end of said strip of thermally expansive material, said tabs being connected to surfaces of one or more thermal-electric cooling means.

15. The spray shower apparatus of claim 14 wherein said one or more thermal-electric cooling means is connected to an electrical source having reversible polarity and further comprising means for reversing such polarity to apply heat or cooling to said thermal expansion element.

16. The spray shower apparatus of claim 1 wherein said thermal expansion element is a double helix strip that surrounds said needle.

17. The spray shower apparatus of claim 1 wherein said thermal expansion element comprises two strips of thermally expansive material positioned adjacent and substantially parallel to each other.

18. The spray shower apparatus of claim 17 wherein said two strips of thermally expansive material are arranged substantially in a plane that is perpendicular to a longitudinal axis of said nozzle housing.

19. The spray shower apparatus of claim 17 further comprising circuit means for including a balancing resistor for controlling the heating of each of said two strips.

20. The spray shower apparatus of claim 17 wherein said two strips of thermally expansive material are fabricated out of a bimetal alloy.

21. A moisturizing nozzle comprising:

a nozzle housing;

a nozzle outlet through which a moisture spray is discharged from the nozzle housing;

control means for controlling the flow of moisture through said nozzle outlet, said control means including:

a thermal expansion element which expands when heated and contracts when cooled or when heat applied is reduced, said thermal expansion element being connected to a shaft for causing said shaft to move to control the flow of the moisture out of such nozzle outlet upon the expansion and contraction of said thermal expansion element;

a heating element in contact with said thermal expansion element for heating said thermal expansion element.

22. The moisturizing nozzle of claim 21 further comprising:

a needle valve mounted in said nozzle housing, said needle valve having a conical tip and wherein said shaft is a needle being positioned in said needle valve to allow said needle to pass at least partly through an upstream flow control orifice which leads to said nozzle outlet.

23. The moisturizing nozzle of claim 22 wherein said thermal expansion element is a tubular body that is positioned around said needle so that the longitudinal axis of said needle is parallel to the longitudinal axis of said tubular body.

24. The moisturizing nozzle of claim 23 wherein said heating element is a second tubular body that surrounds at least a portion of the exterior surface of said thermal expansion element.

25. The moisturizing nozzle of claim 21 further comprising:

an annular orifice surrounding said nozzle outlet;

means for supplying a high velocity annular air stream through said annular in a direction which enables said high velocity air stream to mix with the moisture spray discharged through said nozzle outlet.

26. The moisturizing nozzle of claim 21 wherein said expansion element is a series of concentric tubular bodies.

* * * * *